US007762432B2

(12) United States Patent
Fidrych et al.

(10) Patent No.: US 7,762,432 B2
(45) Date of Patent: Jul. 27, 2010

(54) HYDRATION SYSTEM FOR USE WITH A PACK

(75) Inventors: Paul J. Fidrych, Portland, OR (US); Tory M. Cross, Portland, OR (US)

(73) Assignee: Nike, Inc., Beaverton, OR (US)

( * ) Notice: Subject to any disclaimer, the term of this patent is extended or adjusted under 35 U.S.C. 154(b) by 757 days.

(21) Appl. No.: 11/622,333

(22) Filed: Jan. 11, 2007

(65) Prior Publication Data

US 2008/0169321 A1 Jul. 17, 2008

(51) Int. Cl.
*B67D 7/84* (2010.01)

(52) U.S. Cl. ..... 222/175; 224/148.4

(58) Field of Classification Search ..... 222/175, 222/92, 95, 93; 224/148.1, 148.2, 148.4–148.7, 224/586; 220/495.01, 495.03, 495.06
See application file for complete search history.

(56) References Cited

U.S. PATENT DOCUMENTS

| | | | | |
|---|---|---|---|---|
| 2,187,868 | A | 1/1940 | Sweitzer | |
| 3,367,380 | A * | 2/1968 | Dickey | 383/104 |
| 3,726,276 | A * | 4/1973 | Schumann et al. | 604/92 |
| 4,669,124 | A * | 5/1987 | Kimura | 383/80 |
| 5,174,458 | A | 12/1992 | Segati | |
| 5,427,290 | A | 6/1995 | Thatcher | |
| 5,660,477 | A | 8/1997 | Ichikawa | |
| 5,788,121 | A | 8/1998 | Sasaki et al. | |
| 5,911,406 | A * | 6/1999 | Winefordner et al. | 251/339 |
| 6,039,305 | A * | 3/2000 | Hoskins et al. | 251/342 |
| 6,409,048 | B1 | 6/2002 | Belzeski | |
| D489,603 | S | 5/2004 | Berman | |
| 6,832,852 | B2 | 12/2004 | Wilkes | |
| 6,837,026 | B2 | 1/2005 | Setton | |
| 6,892,915 | B2 | 5/2005 | Mares | |
| 6,921,204 | B2 | 7/2005 | Edwards et al. | |
| 2002/0113101 | A1 * | 8/2002 | Skillern | 224/148.2 |
| 2002/0124294 | A1 * | 9/2002 | McKenzie et al. | 2/69 |
| 2004/0238571 | A1 | 12/2004 | Noell et al. | |
| 2006/0144862 | A1 | 7/2006 | Reichert et al. | |

FOREIGN PATENT DOCUMENTS

| | | |
|---|---|---|
| JP | 2001-309964 | 11/2001 |

* cited by examiner

*Primary Examiner*—Lien T Ngo
(74) *Attorney, Agent, or Firm*—Plumsea Law Group, LLC

(57) ABSTRACT

A pack with a hydration system is disclosed. The hydration system includes a reservoir and a hose. The reservoir comprises a front side and a rear side that maintain a fixed cross section as liquid is filled and/or drained from the reservoir. Also, as the reservoir empties, the rear side contracts towards the front side, which displaces the center of mass of the reservoir closer to a wearer's back.

25 Claims, 6 Drawing Sheets

HYDRATION SYSTEM FOR USE WITH A PACK

BACKGROUND OF THE INVENTION

1. Field of the Invention

The present invention relates generally to hydration systems, and in particular to a hydration system intended for use with a pack.

2. Description of Related Art

Flexible containers of some kind used to store liquid have been previously proposed. Sasaki et al. (U.S. Pat. No. 5,788,121) teaches a bag for a bag-in-box. The Sasaki design comprises a bag body composed of flat portions and side portions that include a folding line where the side portion is folded inwards. The flat potions each comprise an outer film and an inner film. The Sasaki design allows liquids to be transported in large quantities, while providing shock resistance and a self-supporting property.

A drawback of the Sasaki design is the large size associated with the bag-in-box. Sasaki teaches the use of the bag-in-box for transporting large quantities of liquid such as oil, water, as well as other liquids such as milk on large scales. Sasaki does not teach the use of the bag-in-box with a backpack or other portable system that may be carried by an individual for use in various activities including hiking, running or other similar activities.

Ichikawa (U.S. Pat. No. 5,660,477) discloses a liquid container comprising a flexible bag-shaped container body, including two flat portions and two gusset portions. In the Ichikawa design, each of the two gusset portions has a width approximately equal to the width of the flat portions, giving the liquid container an overall square-like shape. Like the Sasaki design, however, the Ichikawa design is not configured for use with a backpack or other such portable system that may be carried by an individual for various activities.

Portable hydration systems have also been proposed. Noell et al. (U.S. patent number 2004/0238571) teaches a disposable hydration pouch that may be used with a backpack or other such system. The Noell design comprises a flexile hydration pouch including a hose or line attached to a valve, where the hose or line may be decoupled from the hydration pouch. This design facilitates filling, storing and cooling the hydration pouch. Additionally, multiple sized pouches may be used with the same backpack and/or hose.

There is a need in the art for a hydration system with a geometry that reduces the tendency of the hydration system to roll or tilt with respect to the back, as is common with current hydration systems that include reservoirs that bulge when filled with liquid. Generally, there is a need in the art for a pack including a hydration system that may solve the problems associated with the prior art.

SUMMARY OF THE INVENTION

A hydration system is disclosed. In one aspect, the invention provides a hydration system configured for use with a pack, comprising: a reservoir and a hose; the reservoir including a front side and a rear side, the front side being disposed closer to the wearer than the rear side; the front side and the rear side being associated with a first stiffness; the reservoir including a first side and a second side associated with a second stiffness; and where the first stiffness is greater than the second stiffness.

In another aspect, the front side and the rear side are associated with a first material and the first side and the second side are associated with a second material.

In another aspect, the front side and the rear side maintain a fixed cross sectional shape as the reservoir contracts and/or expands.

In another aspect, the front side and the rear side are substantially flat.

In another aspect, the front side and the rear side are concave.

In another aspect, the reservoir has a center of mass and wherein the center of mass is displaced towards a front panel of the pack as the volume of the pack is reduced.

In another aspect, the invention provides a hydration system configured for use with a pack, comprising: a reservoir and a hose; the reservoir including a front side and a rear side; and where the front side and the rear side maintain their cross sectional shape during expansion and/or contraction of the reservoir.

In another aspect, the reservoir includes a first side and a second side associated with the front side and the rear side.

In another aspect, the first side and the second side fold inwards.

In another aspect, the first side is associated with a first central crease and the second side is associated with a second central crease.

In another aspect, the first side and the second side are gusset-shaped.

In another aspect, the first side and the second side have a fan fold shape.

In another aspect, the front side and the rear side are stiffer than the first side and the second side.

In another aspect, the reservoir has a center of mass and wherein the center of mass moves towards a front panel of the pack associated with a wearer's back as the volume of liquid in the reservoir is reduced.

In another aspect, the invention provides a hydration system configured for use with a pack, comprising: a reservoir and a hose; where the center of mass of the reservoir is disposed at a first distance from a front panel associated with the pack while the reservoir has a first volume; where the center of mass of the reservoir is disposed at a second distance from the front panel while the reservoir has a second volume that is smaller than the first; and where the second distance is less than the first distance.

In another aspect, the reservoir comprises a front side, a rear side, a first side and a second side.

In another aspect, the rear side of the reservoir contracts towards the front side of the reservoir as the volume of the reservoir is reduced.

In another aspect, the front side and the rear side maintain a constant cross section as the volume of the reservoir is reduced.

In another aspect, the front side and the rear side are stiffer than the first side and the second side.

In another aspect, the front side and the rear side are thicker than the first side and the second side.

In another aspect, the invention provides a hydration system configured for use with a pack, comprising: a reservoir and a hose; the reservoir including a front side and a rear side, the front side being disposed closer to the wearer than the rear side; the front side and the rear side being associated with a first stiffness that is greater than a second stiffness associated with the first side and the second side; where the front side and the rear side maintain their cross sectional shape during either expansion or contraction of the reservoir; where the reservoir has a center of mass that is disposed a first distance from a front panel when the reservoir has a first volume and wherein the center of mass is displaced a second distance when the reservoir has a second volume that is less than the first volume; and where the first distance is greater than the second distance.

In another aspect, the front side and the rear side are substantially flat.

In another aspect, the front side and the rear side are concave.

In another aspect, the first side and the second side are gusset-shaped.

In another aspect, the first side and the second side have a fan fold shape.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
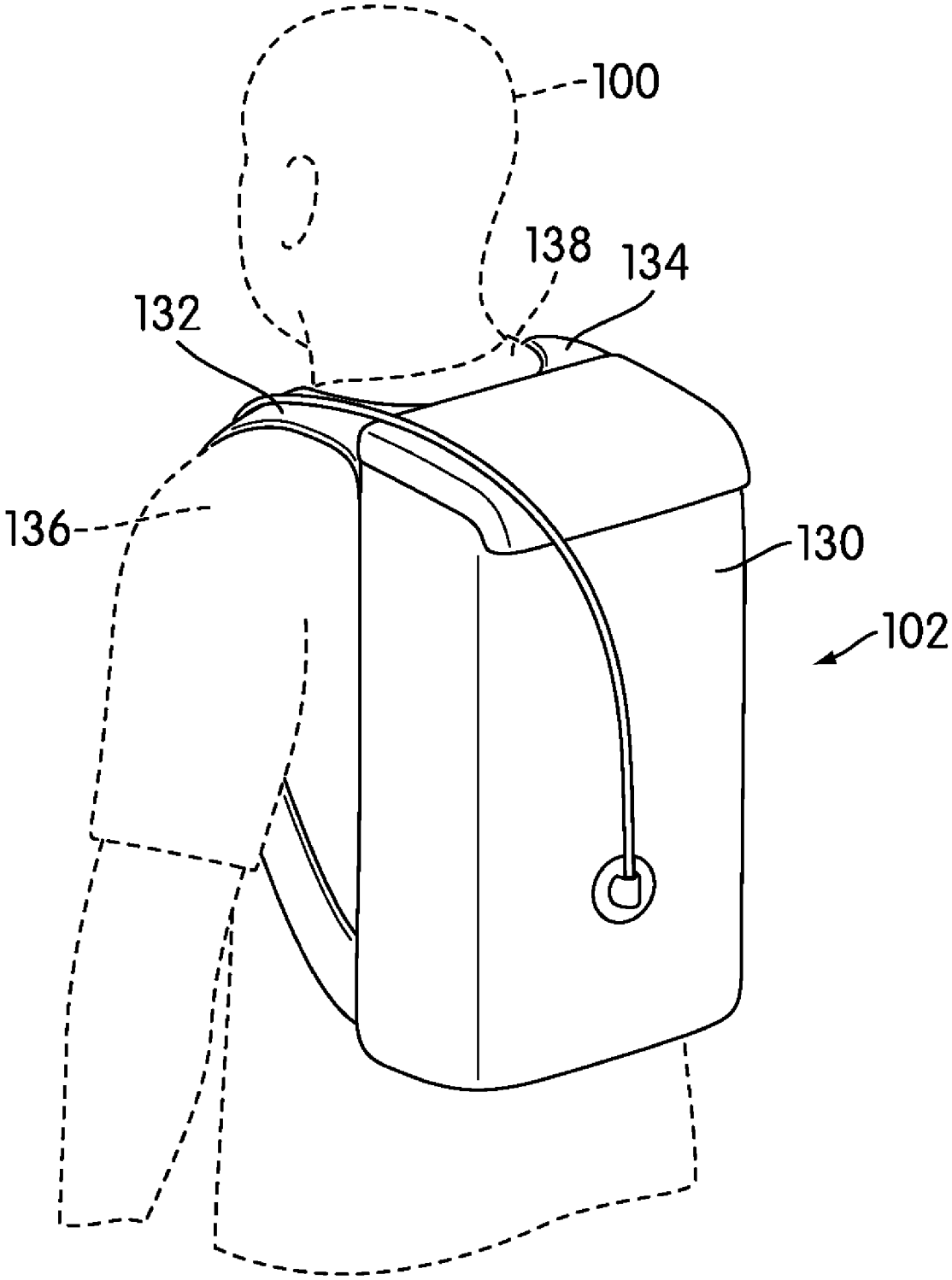
FIG. 1 is an isometric view of a preferred embodiment of a pack.

FIG. 1 is a preferred embodiment of user 100 with pack 102. The term 'pack', as used throughout this detailed description, refers to any device used for carrying items, including, but not limited to, clothing, food, as well as other personal items. Generally, packs may include one or more large central compartments, as well as additional smaller compartments or pockets, intended for storing items. Examples of various types of packs include duffel bags, messenger bags, tote bags, fanny packs, as well as other similar devices. In a preferred embodiment, pack 102 may be a backpack.

In this preferred embodiment, pack 102 may include primary storage compartment 130. Additionally, pack 102 may include first shoulder strap 132 and second shoulder strap 134, associated with left shoulder 136 and right shoulder 138, respectively. For the purposes of clarity, pack 102 is shown here as a generic backpack, however, in other embodiments, pack 102 may include many additional features. Examples of additional features include, but are not limited to, additional storage compartments and/or additional pockets, as well as additional straps, including, hip or waist belts.

Generally, pack 102 may be made from a variety of natural and/or synthetic materials. In some embodiments, pack 102 may be made of leather and/or cotton. In other embodiments, synthetic fabrics may be used, including vinyl, nylon, as well as various other polyamides and/or polyesters. Additionally, pack 102 may be reinforced with various waterproofing agents for protection against rain.

Preferably, in cases where pack 102 may be used during activities such as hiking or running, pack 102 includes provisions for supplying water or other liquids to user 100. In some embodiments, pack 102 may include a reservoir for storing liquids. Additionally, pack 102 may include a provision that allows user 100 to easily access the liquid stored in the reservoir. In a preferred embodiment, pack 102 may include a hydration system, comprising a reservoir for storing liquid, as well as a tube, allowing user 100 to drink directly from the reservoir without having to stop and pour the liquid into a separate container. This hydration system may be useful in cases where user 100 is running or hiking, as it allows the user to stay hydrated without constantly stopping to remove a bottle or other liquid storage device from their pack, in order to drink water. Instead, user 100 may drink liquids at any time, including while moving, reducing the risk of dehydration.

Figure 2:
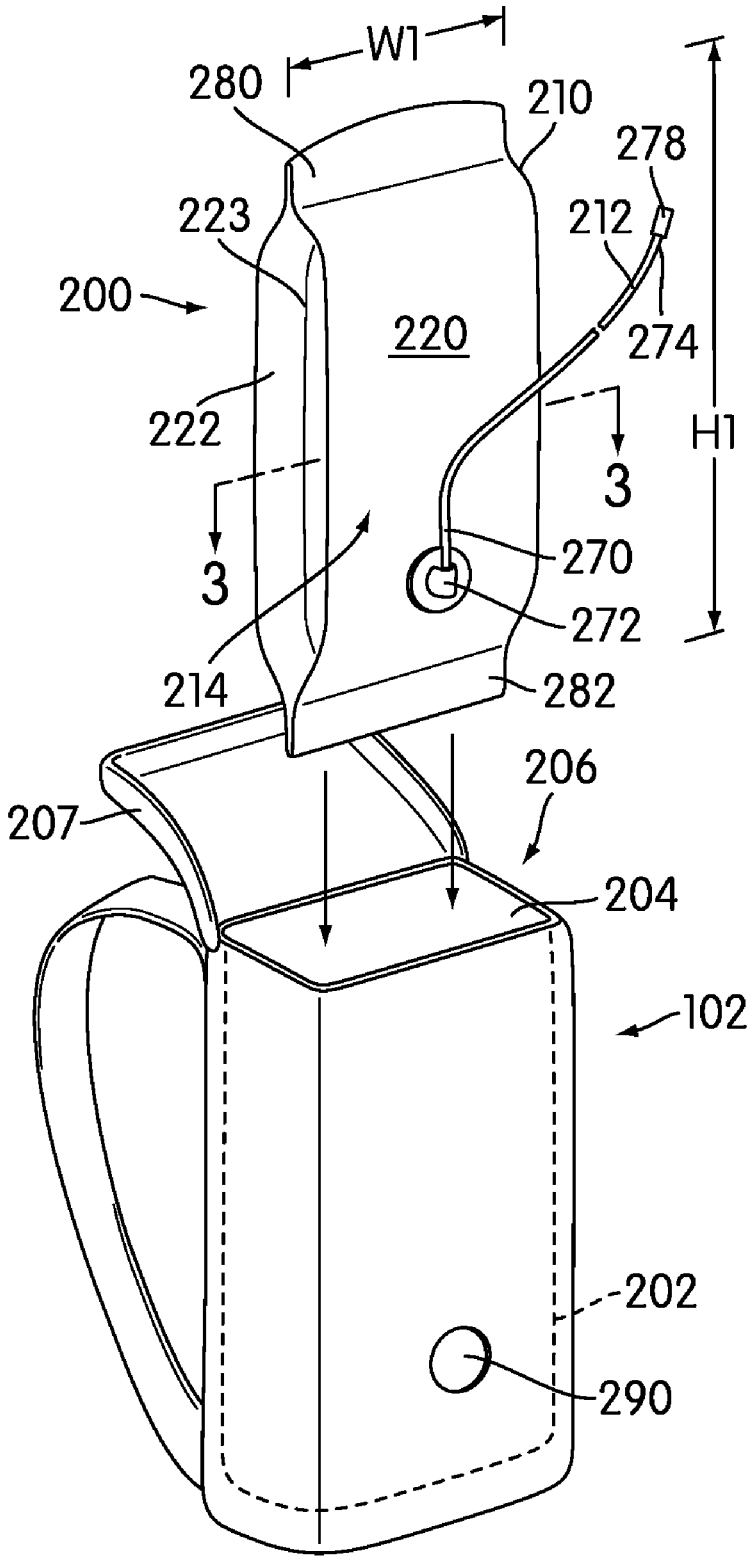
FIG. 2 is an exploded isometric view of a preferred embodiment of a pack and hydration system.
Figure 3:
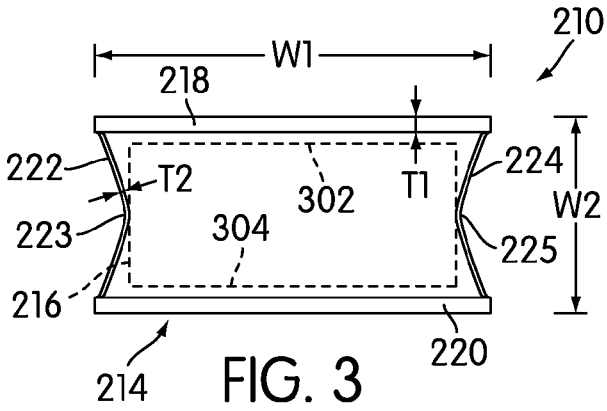
FIG. 3 is a cross sectional view of a preferred embodiment of a reservoir.

Referring to FIGS. 2-3, pack 102 may be associated with hydration system 200. Preferably, hydration system 200 includes reservoir 210. The term 'reservoir', as used throughout this detailed description, refers to any pouch, bag, bladder, or other similar container that may be used to store liquids. Furthermore, a reservoir may be made of a flexible material, as opposed to glass or a rigid plastic that may be used to construct standard bottles or similar liquid storage devices.

Preferably, hydration system 200 also includes hose 212. In some embodiments, hose 212 may be made of a flexible plastic. Generally, first end 270 of hose 212 may be attached to insertion tube 272 of reservoir 210, allowing for fluid communication between hose 212 and the inside of reservoir 210. Second end 274 of hose 212 may include valve 278. In some embodiments, valve 278 may be a bite valve. Preferably, valve 278 is configured to allow a user to draw water from reservoir 210 through hose 212. In a preferred embodiment, valve 278 may be inserted directly into a user's mouth. Using this configuration, a user may draw water or other liquids from reservoir 210 by applying suction to valve 278.

Preferably, pack 102 includes provisions for receiving hydration system 200, including reservoir 210 and hose 212. In some embodiments, pack 102 may include fitted compartment 202. Preferably, fitted compartment 202 is a region within backpack interior 204 that is configured to receive reservoir 210. In a preferred embodiment, fitted compartment 202 may be only slightly larger than reservoir 210, reducing the tendency of reservoir 210 to jostle or move within fitted compartment 202.

In some embodiments, hydration system 200 may be inserted into, and removed from, fitted compartment 202 via opening 206. Generally, opening 206 may be closed using a fastening system. Examples of fastening systems that may be used with opening 206 include, but are not limited to, zippers, buttons, straps, draw-strings, as well as other types of systems. In a preferred embodiment, opening 206 may be associated with flap 207 that may be pulled over opening 206 to close it.

In some embodiments, pack 102 may include hole 290. In the preferred embodiment, hose 212 may be inserted through hole 290, allowing the user access to hose 212 while reservoir 210 is within fitted compartment 202. In some embodiments, pack 102 may include a fastening mechanism of some kind that allows hose 212 to be attached to a portion of pack 102, reducing the tendency of hose 212 to hang below pack 102 when hose 212 is not being used.

In this embodiment, reservoir 210 has a generally rectangular geometry. As seen in FIG. 3, the shape of central portion 214 of reservoir 210 may be approximated by rectangle 216. In particular, reservoir 210 may include front side 218 and rear side 220. Generally, front side 218 will be disposed closer to a wearer's back than rear side 220. Reservoir 210 may also include first side 222 and second side 224. In a preferred embodiment, each of the sides 218, 220, 222 and 224 has a height H1 that is substantially larger than the width W1 of front side 218 and rear side 220. Additionally, first side 222 and second side 224 have a width W2 that is substantially smaller than both height H1 and width W1.

It is preferable, when carrying a load within a backpack, to position the center of mass of the load as close to, and as high on, the back as possible. Because reservoir 210 has a preferably rectangular geometry, with width W2 substantially smaller than height H1 and width W1, the center of mass of the liquid carried within reservoir 210 may be kept close to a user's back. In a preferred embodiment, reservoir 210 may be disposed high on a user's back, so that the center of mass of the load (water or another liquid) carried within reservoir 210 may be disposed high on the user's back.

It should be understood that the cross sectional shape of reservoir 210 is only approximately rectangular. Preferably, front side 218 and rear side 220 are approximately parallel to first side 302 and second side 304 of rectangle 216, respectively. However, first side 222 and second side 224 are generally not parallel to any sides of rectangle 216. Instead, first side 222 and second side 224 may be folded inwards. In some embodiments, first side 222 and second side 224 may be curved inwards in a V shape, with first central crease 223 and second central crease 225. In a preferred embodiment, first side 222 and second side 224 may be gusset-shaped. This gusset arrangement allows for expansion and contraction between front side 218 and rear side 220, while keeping front side 218 and rear side 220 generally parallel. In other words, the cross sectional shape of first side 218 and rear side 220 is maintained during expansion and/or contraction of reservoir 210. Additionally, the tapered configuration of top portion 280 and bottom portion 282 may also help keep front side 218 and rear side 220 parallel while reservoir 210 expands and/or contracts.

Figure 4:
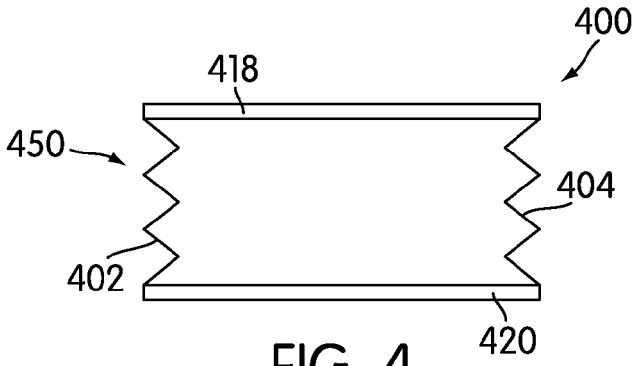
FIG. 4 is a cross sectional view of a preferred embodiment of a reservoir.

Generally, first side 222 and second side 224 may have any shape that allows for expansion and contraction between front side 218 and rear side 220. In another embodiment, for example, first side 222 and second side 224 may have a fan fold geometry. FIG. 4 is a cross sectional view of an alternative embodiment of reservoir 400, including first folded side 402 and second folded side 404. Preferably, sides 402 and 404 include creases 450. In this embodiment, each of the sides 402 and 404 includes 5 creases. In other embodiments, any number of creases may be used. With this fan fold arrangement, rear side 420 may easily contract towards front side 418. This fan fold geometry is only meant to illustrate a variation of the gusset arrangement used with first side 222 and second side 224 in a preferred embodiment. Preferably, there may be other arrangements for first side 222 and second side 224 that may also be used to facilitate the contraction of reservoir 210.

In order to further facilitate the ability of rear side 220 to further contract towards front side 218, while maintaining the cross sectional shapes of front side 218 and rear side 220, sides 218, 220, 222 and 224 may be associated with varying degrees of stiffness. Referring to FIG. 3, front side 218 and rear side 220 may be associated with a first stiffness. Likewise, first side 222 and second side 224 may be associated with a second stiffness. In a preferred embodiment, the first stiffness is greater than the second stiffness. In other words, front side 218 and rear side 220 are stiffer than first side 222 and second side 224.

Variations in stiffness may be achieved by different methods. In some cases, first side 222 and second side 224 may be associated with a material that is less stiff than front side 218 and rear side 220. In some embodiments, first side 222 and second side 224 may be made of a flexible material. In some embodiments, the flexible material may be a flexible plastic material. In an exemplary embodiment, the flexible plastic material may be polyurethane. Additionally, in some embodiments, front side 218 and second side 220 may be made of a substantially rigid material. In some embodiments, the substantially rigid material may be a rigid plastic. In an exemplary embodiment, the rigid plastic may be made of a material containing higher density polyurethane, a thicker polyurethane, or a co-extrusion polyurethane with polyethelene.

In other embodiments, variations in stiffness may be achieved by modifying the thicknesses of sides 218, 220, 222, and 224. In some embodiments, front side 218 and second side 220 may be associated with a first thickness T1. First side 222 and second side 224 may be associated with a second thickness T2. In a preferred embodiment, first thickness T1 is greater than second thickness T2. By varying the thicknesses associated with sides 218, 220, 222 and 224 in this manner, front side 218 and rear side 220 may be stiffer than first side 222 and second side 224, even when sides 218, 220, 222 and 224 are all constructed of the same material.

In traditional reservoir designs, rocking, tilting and/or rolling of the reservoir against a user's back may be a common problem that causes discomfort. This is typically due to the rounded shape of most reservoirs when they are filled to capacity. Preferably, the generally flat shape of front side 218 and rear side 220 of reservoir 210 may reduce the tendency of the reservoir to rock, tilt or roll against the back of the user.

Figure 5:
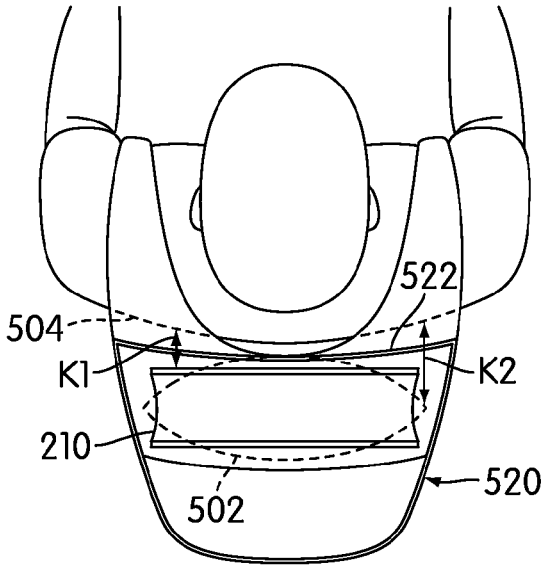
FIG. 5 is a top down view of a preferred embodiment of a pack and hydration system.

Since front side 218 and rear side 220 are preferably rigid they may maintain a generally flat shape. This rigid configuration may substantially reduce the tendency of reservoir 210 to bow along front side 218 and rear side 220. Referring to FIG. 5, reservoir 210 preferably retains a substantially rectangular shape when filled to capacity with a liquid. In contrast, without the rigid support provided by front side 218 and rear side 220, rounded reservoir 502, shown in phantom, may have an oblate spheroid-pillow-shape, associated with the bulging of rounded reservoir 502 when it is filled to capacity. Using this flattened reservoir configuration, first spacing K1 between reservoir 210 and back 504 may be reduced from second spacing K2, which is the spacing between round reservoir 502 and back 504. This reduction in spacing may decrease the tendency of reservoir 210 to rock, tilt or roll against back 504, which may generally interfere with a user's balance and/or cause discomfort.

In some embodiments, pack 520 may be made of a material that reinforces the generally rectangular shape of reservoir 502. In some embodiments, pack 520 may include front panel 522. Front panel 522 may be made of a stiff material that retains a generally flat shape while pack 520 is worn.

Examples of materials from which front panel 522 may be constructed include, but are not limited to, foams, plastics, metals, as well as other materials. In a preferred embodiment, front panel is constructed as a fabric lining that envelops a stiff material. In other embodiments, front panel 522 may be flexible and therefore substantially conform to the shape of reservoir 210.

In the following discussion, it should be understood that wherever the geometry of the reservoir is modified from this current embodiment, the geometry of front panel 522, as well as other portions of backpack 520, may be modified in a like manner to conform to the new shape of reservoir 210. Alternatively, front panel 522 may be constructed as a flexible panel that generally conforms to any shape presented by reservoir 210.

Generally, a user's back is not flat, but instead has a convex shape. Preferably, a pack and an associated hydration system include provisions for fitting to the contour of the user's back, which may further reduce the tendency for the hydration system and/or pack to rock, tilt or roll against a user's back. In some embodiments, the shape of the backpack and the hydration system may be curved. In a preferred embodiment, the shape of the pack and the hydration system may be concave.

Figure 6:
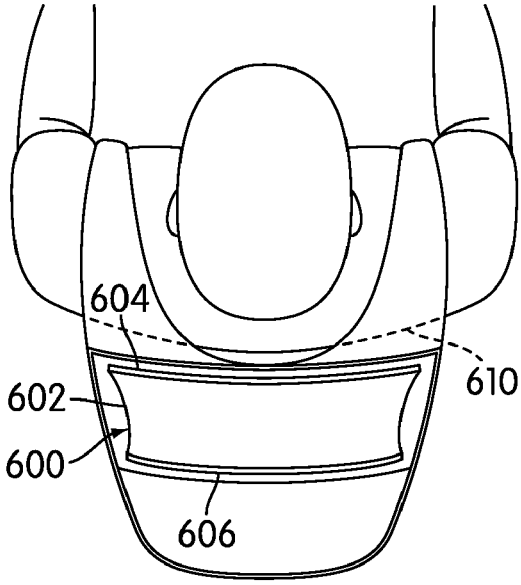
FIG. 6 is a top down view of a preferred embodiment of a pack and hydration system.

Referring to FIG. 6, reservoir 602 of hydration system 600 may include front side 604 and rear side 606. In this embodiment, front side 604 may be slightly concave in a manner that fits the convex shape of back 610. In particular, front side 604 preferably has a concave shape. In some embodiments, rear side 606 preferably also has a concave shape. With this concave arrangement, front side 604 and rear side 606 may be coincident, so that front side 604 and rear side 606 may fit together when reservoir 602 has been emptied.

In some cases, it may be preferable that a pack with a hydration system includes provisions for facilitating ventilation of a user's back. In some embodiments, the pack may have a ribbed shape that reduces the contact area with the back. In a preferred embodiment, the reservoir of the hydration system is also constructed to have a ribbed shape that is coincident with the ribbed shape of the pack.

Figure 7:
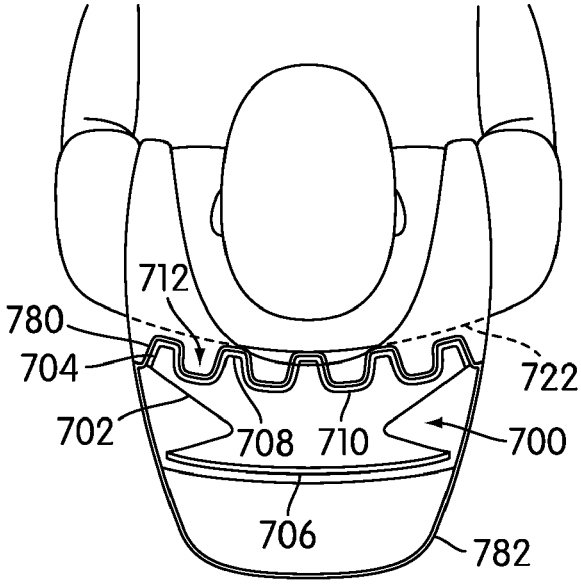
FIG. 7 is a top down view of a preferred embodiment of a pack and hydration system.

Referring to FIG. 7, reservoir 702 of hydration system 700 may include front side 704 and rear side 706. In this embodiment, front side 704 may comprise ribbed portions 708. Preferably, ribbed portions 708 extend from base surface 710, forming gaps 712. This ribbed arrangement may reduce the area of contact between back 722 and front side 704, thus increasing ventilation to back 722 through gaps 712. In a preferred embodiment, front panel 780 pf pack 782 has a shape that is coincident with front side 704 of reservoir 702. In order to achieve this ribbed arrangement in front side 704 and front panel 780, front side 704 and/or front panel 780 may be made of a thermoformed sheet material.

As previously discussed, positioning the center of mass of the reservoir high on, and close to, the back of a user is ideal. This arrangement may make the load carried by the user 'feel' lighter. An important feature of the present embodiment is the ability of the reservoir to contract as liquid is drained, allowing the center of mass to remain relatively high on, and close to, the user's back. As used in this detailed description, the center of mass of the reservoir refers to the center of mass of the reservoir including any liquid contained within the reservoir. In many cases, due to the lightweight nature of the reservoir, the center of mass of the reservoir/liquid system will be dominated by the weight of the liquid.

Figure 8:
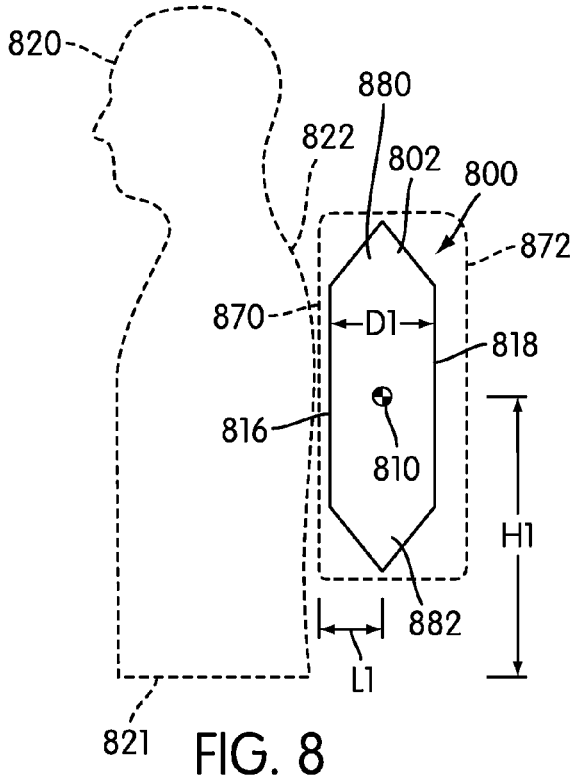
FIG. 8 is a side view of a preferred embodiment of a reservoir.

Referring to FIG. 8, reservoir 802 of hydration system 800 may be originally filled to full capacity. At this point, reservoir 802 has a first volume. Front side 816 is displaced a distance D1 from rear side 818. Therefore, center of mass 810 may be disposed halfway between front side 816 and rear side 818 in the horizontal direction and halfway between top portion 880 and bottom portion 882 in the vertical direction. In this embodiment, center of mass 810 may be disposed at a height H1 with respect to waistline 821 of user 820. Additionally, first center of mass 810 may be disposed at a length L1 from front panel 870 of pack 872. Generally, the positioning of center of mass 810 is high on back 822. Also, first center of mass 810 is substantially close to back 822. This high and close center of mass arrangement is the preferred arrangement for any load being carried by user 820 in a pack 872.

Figure 9:
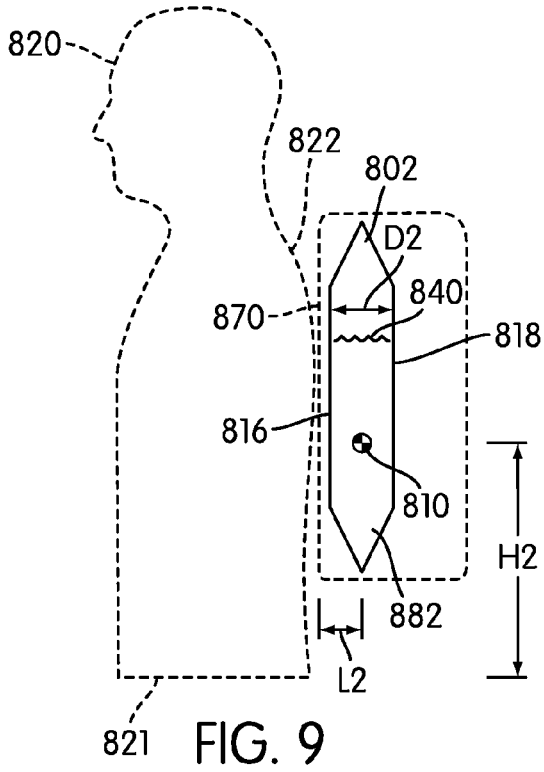
FIG. 9 is a side view of a preferred embodiment of a reservoir.

FIG. 9 illustrates the position of center of mass 810 following a reduction of the volume of liquid in reservoir 802. In this embodiment, rear side 818 has contracted towards front side 816, and is now displaced a distance D2, which is significantly smaller than distance D1 from front side 816. Again, center of mass 810 may be disposed halfway between front side 816 and rear side 818 in the horizontal direction and halfway between water level 840 and bottom portion 882 in the vertical direction. Following this displacement, center of mass 810 is disposed at a height H2 with respect to waistline 821, and a length L2 from front panel 870. L2 is generally smaller than L1, since front side 816 has contracted towards back 822, thus contracting center of mass 810 towards back 822. Furthermore, although liquid has been removed from reservoir 802, the contraction of front side 816 has redistributed the liquid, generally keeping water level 840 high within reservoir 802. Therefore, center of mass 810 has not dropped much, as it is clear that height H2 is still about 80% of the value of height H1.

This contracting reservoir arrangement helps to maintain the center of mass close to, and high on, a user's back. This is in contrast to a traditional reservoir system where as liquid drains from the reservoir, the center of mass of the liquid will be lowered. In some cases, if the reservoir is flexible enough to bulge, the center of mass may be displaced further from the back.

Figure 10:
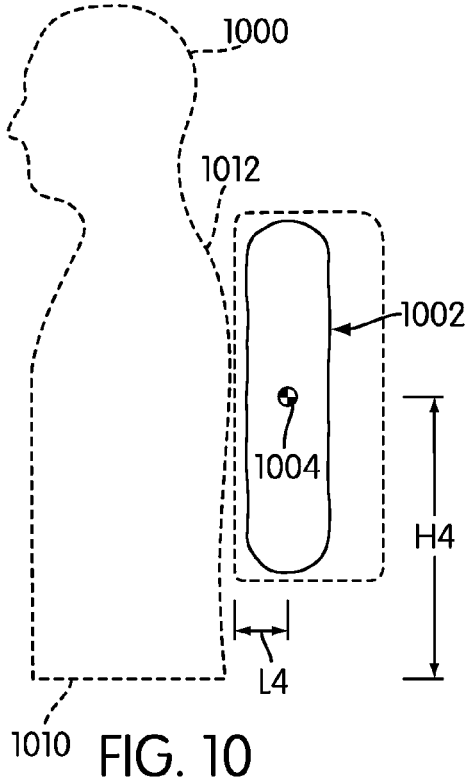
FIG. 10 is side view of a preferred embodiment of a traditional reservoir.

FIG. 10 is a side cross sectional view of reservoir 1002 that has been filled to capacity. Generally, reservoir 1002 may have a rounded or 'pillow' shape when filled to capacity. In this embodiment, center of mass 1004 is disposed at a height H4 from waistline 1010, and a length L4 from back 1012 of user 1000.

Figure 11:
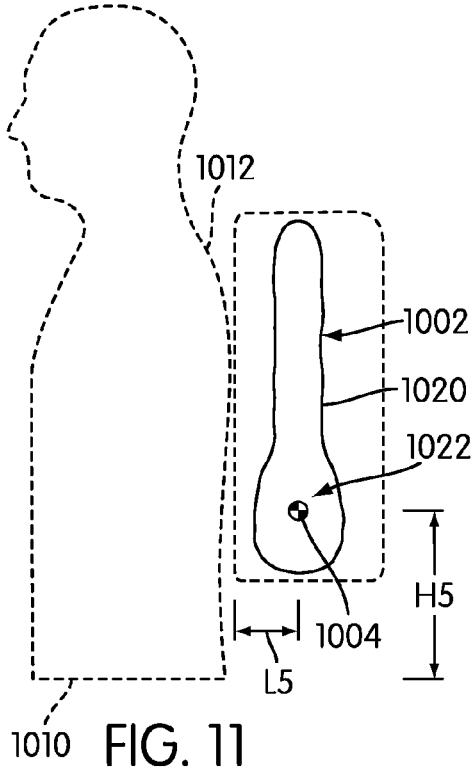
FIG. 11 is side view of a preferred embodiment of a traditional reservoir.

As liquid drains from reservoir 1002, walls 1020 of reservoir 1002 may become slack, as seen in FIG. 11. In many cases, the liquid will pool in bottom portion 1022 of reservoir 1002, which may bulge outwards in all directions. In particular, this bulge may shift reservoir 1002 further from back 1012. Furthermore, as walls 1020 expand under the pressure of the liquid along bottom portion 1022, center of mass 1004 may be displaced further away from back 1012. In this embodiment, center of mass 1004 may be disposed at a height H5 from waistline 1010, and a length L5 from back 1012. In this case it is clear that height H5 is substantially smaller than height H4, and length L5 is substantially longer than length L4. Thus, center of mass 1004 is generally lower on, and farther from, back 1012. This arrangement may lead to a feeling that the load is 'heavier' than it would be if center of mass 1004 was disposed closer to, and higher on, back 1012.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A hydration system comprising:

a pack storing a reservoir and a portion of a hose;

the pack including a front panel and a rear panel;

the reservoir including a front side and a rear side;

the front side and the front panel configured to be disposed closer to the wearer than the rear side;

the front side and the rear side being associated with a first stiffness;

the reservoir including a first side and a second side associated with a second stiffness;

wherein the first stiffness is greater than the second stiffness; and wherein the front panel and the front side include corresponding ribbed portions.

2. The hydration system according to claim 1, wherein the front side and the rear side are associated with a first material and the first side and the second side are associated with a second material.

3. The hydration system according to claim 2, wherein the front side and the rear side maintain a fixed cross sectional shape as the reservoir contracts and/or expands.

4. The hydration system according to claim 3, wherein the front side and the rear side are substantially flat.

5. The hydration system according to claim 4, wherein the front side and the rear side are concave.

6. The hydration system according to claim 5, wherein the reservoir has a center of mass and wherein the center of mass is displaced towards the front panel of the pack as the volume of the pack is reduced.

7. A hydration system comprising:

a pack storing a reservoir and a portion of a hose;

the pack including a front panel and a rear panel;

the reservoir including a front side and a rear side;

the front side and the front panel configured to be disposed closer to the wearer than the rear side;

wherein the front side and the rear side maintain their cross sectional shape during expansion and/or contraction of the reservoir; and wherein the front panel and the front side include a plurality of corresponding gaps for providing ventilation.

8. The hydration system according to claim 7, wherein the reservoir includes a first side and a second side associated with the front side and the rear side.

9. The hydration system according to claim 8, wherein the first side and the second side fold inwards.

10. The hydration system according to claim 9, wherein the first side is associated with a first central crease and the second side is associated with a second central crease.

11. The hydration system according to claim 10, wherein the first side and the second side are gusset-shaped.

12. The hydration system according to claim 8, wherein the first side and the second side have a fan fold shape.

13. The hydration system according to claim 8, wherein the front side and the rear side are stiffer than the first side and the second side.

14. The hydration system according to claim 8, wherein the reservoir has a center of mass and wherein the center of mass moves towards the front panel of the pack associated with a wearer's back as the volume of liquid in the reservoir is reduced.

15. A hydration system comprising:

a pack storing a reservoir and a portion of a hose;

the pack including a front panel and a rear panel;

the reservoir including a front side and a rear side;

the front side and the front panel configured to be disposed closer to the wearer than the rear side;

wherein a center of mass of the reservoir is disposed at a first distance from the front panel associated with the pack while the reservoir has a first volume;

wherein the center of mass of the reservoir is disposed at a second distance from the front panel while the reservoir has a second volume that is smaller than the first;

wherein the second distance is less than the first distance and wherein the front panel and the front side comprise coincident ribbed shapes.

16. The hydration system according to claim 15, wherein the reservoir comprises a front side, a rear side, a first side and a second side.

17. The hydration system according to claim 16, wherein the rear side of the reservoir contracts towards the front side of the reservoir as the volume of the reservoir is reduced.

18. The hydration system according to claim 17, wherein the front side and the rear side maintain a constant cross section as the volume of the reservoir is reduced.

19. The hydration system according to claim 16, wherein the front side and the rear side are stiffer than the first side and the second side.

20. The hydration system according to claim 19, wherein the front side and the rear side are thicker than the first side and the second side.

21. A hydration system comprising:

a pack storing a reservoir and a portion of a hose;

the pack including a front panel and a rear panel, the reservoir including a front side and a rear side, the front side and the front panel configured to be disposed closer to the wearer than the rear side;

the front side and the rear side being associated with a first stiffness that is greater than a second stiffness associated with a first side and a second side;

wherein the front side and the rear side maintain their cross sectional shape during either expansion or contraction of the reservoir;

wherein the reservoir has a center of mass that is disposed a first distance from the front panel when the reservoir has a first volume and wherein the center of mass is displaced a second distance when the reservoir has a second volume that is less than the first volume;

wherein the first distance is greater than the second distance; and wherein the front panel and the front side include a plurality of corresponding ribbed portions.

22. The hydration system associated with claim 21, wherein the front side and the rear side are substantially flat.

23. The hydration system associated with claim 21, wherein the front side and the rear side are concave.

24. The hydration system associated with claim 21, wherein the first side and the second side are gusset-shaped.

25. The hydration system associated with claim 21, wherein the first side and the second side have a fan fold shape.

* * * * *